US005533629A

United States Patent [19]

Ito et al.

[11] Patent Number: 5,533,629

[45] Date of Patent: Jul. 9, 1996

[54] VORTEX PNEUMATIC CLASSIFIER

[75] Inventors: Mitsuhiro Ito; Takamiki Tamashige, both of Chiba-ken; Satoru Fujii, Yamaguchi-ken, all of Japan

[73] Assignee: Onodo Cement Co., Ltd, Japan

[21] Appl. No.: 313,263

[22] PCT Filed: Mar. 29, 1994

[86] PCT No.: PCT/JP94/00502

§ 371 Date: Sep. 30, 1994

§ 102(e) Date: Sep. 30, 1994

[87] PCT Pub. No.: WO94/22599

PCT Pub. Date: Oct. 13, 1994

[30] Foreign Application Priority Data

| | | | |
|---|---|---|---|
| Mar. 31, 1993 | [JP] | Japan | 5-074670 |
| Dec. 28, 1993 | [JP] | Japan | 5-336492 |
| Dec. 28, 1993 | [JP] | Japan | 5-336493 |

[51] Int. Cl.[6] ..... B04B 5/12

[52] U.S. Cl. ..... 209/714

[58] Field of Search ..... 209/714, 713, 209/143, 142

[56] References Cited

U.S. PATENT DOCUMENTS

| | | | |
|---|---|---|---|
| 4,689,141 | 8/1987 | Folsberg | 209/714 |
| 4,869,786 | 9/1989 | Hanke | 209/714 X |
| 4,919,795 | 4/1990 | Fujii et al. | 209/714 X |

FOREIGN PATENT DOCUMENTS

| | | |
|---|---|---|
| 5919738 | 5/1984 | Japan . |
| 62-174681 | 11/1987 | Japan . |
| 1270982 | 10/1989 | Japan . |
| 312366 | 3/1991 | Japan . |
| 478972 | 7/1992 | Japan . |
| 4243582 | 8/1992 | Japan . |

*Primary Examiner*—David H. Bollinger

*Attorney, Agent, or Firm*—Price, Heneveld, Cooper, DeWitt & Litton

[57] ABSTRACT

Precise classifying of granular or powdered raw material at the desired classifying point by means of a vortex pneumatic classifier comprising: a rotor, a plurality of vortex flow adjusting vanes provided on the said rotor, a classifying chamber defined around the said vortex flow adjusting vanes, and guide vanes radially opposing the said vortex flow adjusting vanes across the said classifying chamber, wherein the mounting pitch P of the said vortex flow adjusting vanes is determined in relation to the classifying particle diameter Dp(th) so as to meet the condition of the following relation expression $$P \leqq 1.04 \times Dp(th)^{0.365}.$$

19 Claims, 17 Drawing Sheets

VORTEX PNEUMATIC CLASSIFIER

TECHNICAL FIELD

This invention relates to a vortex pneumatic classifier to be used for the object of classifying granular or powdered raw material, such as cement, calcium carbonate, ceramics, etc.

BACKGROUND ART

A conventional vortex pneumatic classifier disperses with air flow particulate raw material, for example, granular or powdered material such as limestone dust, classifies the said granular or powdered material into coarse powder and fine powder employing the balance between centrifugal force and drag force, and at the same time, discharges the said fine powder to the exterior of the machine, which then becomes product. (See Japanese Patent Publication No. 57-24189.)

As is generally known, in the event that the theoretical classifying particle diameter Dp(th) [m] is where the particle Reynolds number Rep=Dp(th) Vr ρf/μ<2, it can be obtained by the general formula described below.

$$Dp(th) = (1/Vt)\sqrt{18\mu(D/2)Vr/\rho p}$$

In this general formula, Vt indicates the peripheral speed (m/s) of the tip of the vortex flow adjusting vanes, μ indicates the viscosity coefficient of the air (Pa.S), D indicates the rotor diameter (m), Vr indicates the speed of the inwardly flowing air (m/s) at the tip of the vortex flow adjusting vanes, and ρp indicates the density of the air.

However, upon comparison of the theoretical classifying particle diameter Dp(th) obtained from the said general formula and the classifying particle diameter obtained from actual classifying Dp(obs), it has been found that the Following relationship exists between the two, and these two do not necessarily agree.

$$Dp(obs) \geqq Dp(th)$$

That is to say, the smaller that the target classifying particle diameter becomes, the larger the classifying particle diameter actually obtained Dp(obs) becomes as compared to the theoretical classifying particle diameter Dp(th).

This inventor has found the following to be true, upon studying the cause of the said relationship between the particule diameter Dp(th) and the particule diameter Dp(obs).

As shown in FIG. 6, the tangential direction flow speed distribution of the flow within the vortex-type pneumatic classifier which is provided with guide vanes A8 and vortex flow adjusting vanes (rotor blades) A6 which are opposed across the classifying chamber A7 is described as W in FIG. 6. The classifying particle diameter Dp is determined by the balance between; centrifugal forces $F_{cA}$ and $F_{cB}$ which are dependent on tangential direction flow speeds $V_{tA}$ and $V_{tB}$, and drag forces $F_{dA}$ and $F_{dB}$ which are dependent on inwardly flowing air speed.

This classifying particle diameter Dp gradually becomes smaller upon the radius which extends from the guide vane part A to the vortex adjusting vane tip part B, and becomes larger again on the inside of the vortex adjusting vane tip.

Therefore, of the classifying material placed between the guide vanes A8 and the vortex flow adjusting vanes A6, the particles which are larger than the classifying particle diameter at point B are recovered to the coarse powder side, while the particles which are smaller than this are recovered to the fine powder side. That is to say that the classifying particle diameter for this machine is the classifying particle diameter $D_{pB}$ at point B.

As mentioned above, the classifying particle diameter $D_{pB}$ is determined by the tangential direction flow speed $V_{tB}$ and inwardly flowing air speed at this point, the actual tangential direction flow speed $V_{tB}$ does not necessarily agree with the rotor peripheral speed, but has a slight delay. That is to say, the flow speed of the tangential direction flow speed distribution W at point B is slower than the rotor peripheral speed R indicated by the broken line.

On the other hand. $V_{tB}$ uses the rotor peripheral speed R for calculation of the theoretical classifying particle diameter Dp(th). This is the reason for the difference between the theoretical classifying particle diameter Dp(th) and the actual classifying particle diameter Dp(obs). Especially, in instances where the rotor peripheral speed is great, the difference between the tangential direction flow speed and that of the guide vane part becomes great, and then sufficient acceleration does not occur in this space, so that this tendency becomes prominent. As clearly shown from the said, desired classifying at a desired classifying point cannot be executed by making use of a general formula.

Also, with a conventional vortex pneumatic classifier, the classifying raw material is supplied from the upper portion, and enters the classifying chamber while being dispersed by dispersion plates. On the other hand, the air necessary for classifying is pulled in between guide vanes secured and arrayed around the entire perimeter of the classifier by a fan to the rear of the classifier.

At this point, the classifying air begins homogeneous vortex action as a result of these guide vanes, and is further accelerated by the rotor blades (vortex flow adjusting blades) to the speed necessary for classifying.

That is to say, if the space between the guide vanes and the rotor blades is defined as classifying space, the air flow within that space can be considered to be a two-dimensional vortex flow.

Particles supplied to the classifying space begin vortex action with this vortex flow, and are classified by the balance between centrifugal force and drag force acting upon the particles.

As a result, particles smaller than the classifying particle diameter determined by the balance between the two said forces enter into the interior of the rotor, and are discharged and gathered passing through a discharge duct.

On the other hand, large particles fall by gravity while repeatedly receiving classifying action, and are discharged from a coarse powder discharge duct.

Further, control of the classifying particle diameter is performed by rotor rotational speed or classifying air flow rate, i.e., the centrifugal force or the drag force, acting upon the particles.

Also, in order to perform fine powder classifying, it is necessary to provide great centrifugal force to the particles, and it is necessary to increase the rotational speed of the rotor blades to this end.

However, increasing the said rotational speed causes pressure loss of the said vortex pneumatic classifier owing to circling and turbulence of the air necessary for classifying, necessitating increasing the capacity of the fan providing suction of air. At this time, in the event that there is delay of the air flow as compared to the speed of the rotor blades as said, it becomes necessary to provide extra rotation to the rotor in order to conduct the targeted classifying, and the pressure loss is further increased.

This results in facilities and investments which are overly great, and creates great problems concerning conservation of resource energy. Classifying of powder material such as cement falls in the category of fine powder classifying, and is a relatively coarse classifying of such. Therefore, pressure loss is relatively low, but there is great production volume involved with this sort of powder material, and the proportion of energy costs against the powder material price is of a great proportion, so that the effects of even a small decrease in pressure are great.

In light of the said conditions, this invention aims at classifying granular or powdered material at the desired classifying point not only easy but also accurate.

Another object is to attempt to decrease pressure loss.

DISCLOSURE OF THE INVENTION

This inventor conducted experiments wherein factors thought to affect the classifying point were changed, for example, spacing between the vortex flow adjusting vanes, i.e., mounting pitch P (m) and classifying particle diameter Dp(th) (m), and the results of FIG. 4 were obtained. In FIG. 4, the vertical axis represents the vortex flow adjusting vanes mounting pitch P (m), and the horizontal axis represents the classifying particle diameter Dp (m). L1~L4 indicate cases where the classifying particle diameter Dp(th) is 2.9 μm, 4.8 μm, 6.8 μm, and 10.0 μm, respectively. As a result, connecting the various classifying points at which the particle diameter Dp(th) and the particle diameter Dp(obs) agree resulted in the straight Line L. The relationship between the particle diameter Dp(th) upon this Line L and the mounting pitch P can be represented in the following P-DP relational expression (1);

$$P \leqq 104 \times Dp(th)^{0.365} \quad (1)$$

When the said general formula is substituted for the right-hand side of expression (1), the following expression (2) is obtained;

$$P^{2.74} \leqq 1.11 \sqrt{18\mu/\rho p} \cdot \sqrt{(D/2)Vr/Vt} \quad (2)$$

When the diameter of the vortex flow adjusting vanes and of the rotor is expressed as D (m), height as H (m), and classifying air flow rate as Q ($m^3$/s), the inwardly flowing air speed Vr (m/s) can be described with the following expression (3);

$$Vr = Q/(\pi DH) \quad (3)$$

The correctional pitch expression (4) can be obtained from the expression (2) and the expression (3);

$$P^{2.74} \leqq 1.11 \sqrt{18\mu/2\rho p \pi H} \cdot \sqrt{Q}\ /Vt \quad (4)$$

Therefore, this inventor aims to achieve the said object by means of a vortex pneumatic classifier comprising: a rotor, a plurality of vortex flow adjusting vanes provided on the said rotor, a classifying chamber defined around the said vortex flow adjusting vanes, and guide vanes radially opposing the said vortex flow adjusting vanes across the said classifying chamber, wherein the mounting pitch P of the said vortex flow adjusting vanes is determined in relation to the classifying particle diameter Dp(th) so as to meet the condition of the said P-Dp relation expression.

In order to find where the main pressure loss was occurring, this inventor measured the pressure loss of the entire classifier and the pressure loss only of the outside of the rotor blade outer perimeter, obtaining the results shown in FIG. 7.

In FIG. 7, Curve CA represents the pressure loss of the entire classifier, and Curve CB represents pressure loss only of the outside of the rotor blade outer perimeter, this Curve CB is that obtained where the dynamic pressure and static pressure at the out side of the rotor blade outer perimeter were measured, and the sum thereof, i.e., the difference between the total pressure and the total pressure at the classifying chamber inlet was studied.

According to this experiment, a great portion of the pressure loss occurs at the interior of the rotor, i.e., within the rotor chamber. Therefore, along with researching the cause of occurrence of the said pressure loss, methods to decrease pressure loss within the rotor chamber were researched.

The loss of pressure within the rotor chamber can be thought to be resultant of: (A) centrifugal force from circling air, (B) fluid friction loss based on differences in speed of neighboring fluid particles, (C) friction between the inner wall of the classifier and the fluid matter. In order to minimize the causes of (A) and (B), with the fact in mind that at the rotor blade portion the circumferential component of the air speed is the same as that of the rotor blade, it is desirable that the circling on the inner side of the rotor blade be that of a nature where the shearing stress, i.e., the trans-fluid friction loss is minimal, and centrifugal force is also minimal, i.e., a forced vortex within which the angular velocity of rotation is constant at the rotor radius position.

However, in reality the air which flows from the classifying chamber into the rotor maintains approximately the same circumferential speed as the rotor blade while passing between the rotor blades in a turbulent condition, and enters to the inner side. Therefore, the said air, upon heading toward the rotor axis center owing to moment of inertia, increases in circumferential speed component to a certain radius position, and from there becomes a Burgers vortex which forms a forced vortex, and the position at which it becomes a forced vortex is generally close to the radius of the exit of the rotor chamber. From this, it has been found that it is possible to form a forced vortex without forming a Burgers vortex, by lengthening the inner diameter of the rotor blade to approximately the radius of the exhaust opening of the rotor chamber.

It has also been found that, by providing inside the rotor chamber a flow straightening member which is coaxial with the rotor's rotary shaft, it is possible to smoothly convert the flow direction toward the discharge duct.

This inventor aims at achieving the said objects by the following configuration.

(1) A vortex pneumatic classifier comprising: a rotor, a plurality of vortex flow adjusting vanes (rotor blades) provided on the said rotor, a classifying chamber defined around the said vortex flow adjusting vanes, and guide vanes radially opposing the said vortex flow vanes across the said classifying chamber, wherein the mounting pitch P of the said vortex flow adjusting vanes is determined in relation to the classifying particle diameter Dp(th) so as to meet the condition of the following relation expression P-Dp $$P \leqq 1.04 \times Dp(\mathrm{th})^{0.385} \quad (1)$$

(2) A vortex pneumatic classifier comprising: a rotor chamber with an inlet and an exhaust duct, a plurality of rotor blades placed at intervals circumferential around the rotor at the inlet of the said rotor chamber, and a classifying chamber provided at the perimeter of the said rotor chamber, wherein the radial direction length of the said rotor blade is 0.7~1.0 times the difference between the rotor blade outer perimeter radius and the radius of the rotor chamber exhaust duct.

(3) A vortex pneumatic classifier comprising: a rotor chamber with an inlet and an exhaust duct, rotor blades placed at the inlet of the said rotor chamber, and a classifying chamber provided at the perimeter of the said rotor chamber, wherein a flow-straightening member is provided inside the said rotor chamber in a concentrical manner with the rotary shaft.

THE BEST MODE FOR CARRYING OUT THE INVENTION

Figure 1:
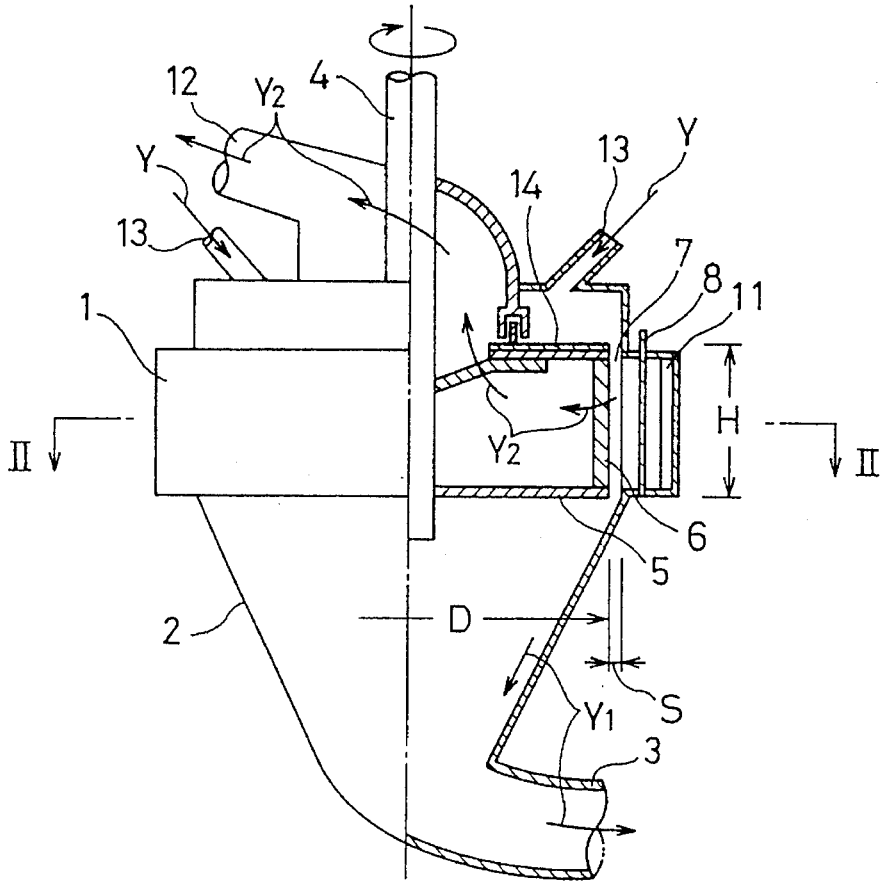
FIG. 1 is a partial cross-sectional front view which shows an embodiment of this invention.

The 1st embodiment of this invention is explained with the attached diagram.

A conical hopper 2 is provided at the lower portion of the cylindrical casing 1, and the lower portion of the said hopper 2 is made to communicate with the coarse powder discharge duct 3. In the center of the interior of the casing 1, a rotor 5 is positioned being secured to the rotational axis 4. The diameter of this rotor 5 is D, and the height thereof is H.

A plurality of vortex flow adjusting vanes (rotor blades) 6 are provided at the perimeter of the rotor 5, and the mounting pitch P thereof is obtained by the said P-Dp relational expression (1), or the said correctional pitch expression (4);

$$P \leqq 1.04 \times Dp(th)^{0.365} \quad (1)$$

$$P^{2.74} \leqq 1.11 \sqrt{18\mu/2\rho p\pi H} \cdot \sqrt{Q}\ /Vt \quad (4)$$

Next, under the following conditions, explanation will be made concerning the pitch P in the event that limestone with a particle density of $\rho p$=2700 kg/m$^3$ is classified.

Rotor diameter D=2.1 m, rotor height H=0.3 m, air density pf=1.20 kg/m$^3$ at 20.0° C. in one atmospheric pressure, air viscosity coefficient $\mu$=1.81×10$^{-5}$ (Pa.s) at 20.0° C. in one atmospheric pressure.

Under the said conditions, the mounting pitch P (m) of the vortex flow adjusting vanes necessary to attain the theoretical classifying particle diameter Dp(th) (m) is as shown in Table 1. The value of this pitch (m) may be, from the said P-Dp relational expression (1), determined as the minimal classifying diameter applicable to the classifier, for example, a classifier applicable to classifying to 3 μm.

TABLE 1

| Dp(th) | Q(m$^3$/s) | Vt(m/s) | P(m) |
|---|---|---|---|
| 20.0 × 10$^{-6}$ | 6.67 | 32.7 | 20.0 × 10$^{-3}$ |
| 10.0 × 10$^{-6}$ | 6.67 | 65.3 | 15.6 × 10$^{-3}$ |
| 3.0 × 10$^{-6}$ | 6.67 | 217.8 | 10.0 × 10$^{-3}$ |

Further, Q represents the classifying air flow rate (m$^3$/s), and Vt represents circumferential speed at the vortex adjusting vane tip (m/s).

Guide vanes 8 which are capable of angle adjustment are positioned radially opposing the said vortex flow adjusting vanes across the classifying chamber 7 around the said vortex flow adjusting vanes. The determination of the width S of this classifying chamber 7 is extremely important. Also, the more that the width S is narrowed and the speed slope steepens for the tangential direction flow speed distribution W, the stronger the shearing force owing to the speed differences of air flow acts upon the agglomerations at this position, accelerating dispersion, and effective classifying is made possible.

However, if the said width S is too narrow, the vortex is disturbed. As a result, the forces acting upon the granular or powdered material within the classifying chamber are also disturbed, making normal classifying impossible.

In the reverse case, if the width S of the said classifying chamber is too wide, the dispersion action owing to the speed slope of the air flow between the said guide vanes and rotor blades becomes insufficient, and the agglomeration goes out the classifying chamber 7, without having been dispersed into single particles, and classifying efficiency declines.

As a result of experiments conducted to therefore determine the appropriate value for the width S of the classifying chamber 7, the following S-P relation expression (5) was obtained. Provided that P is the rotor blade mounting pitch, coefficient K=5~20.

$$S = K\sqrt{P} \quad (5)$$

The ratio T/P between the pitch P (m) and the thickness T of the circumferential direction of the vortex flow adjusting vanes 6 is made to be 0.60 or less, and the aperture area M of rotor 5 is formed at 40% or greater.

According to the experiments, in the case that the thickness T of the circumferential direction of the said vortex flow adjusting vanes 6 exceeds this range, the vortex in the vicinity of the said vortex flow adjusting vanes 6 is disturbed, even if the width S of the said classifying chamber 7 and the mounting pitch P of the vortex flow adjusting vanes 6 are within the above-mentioned range, and, for example, there are cases of increased scattering in of coarse powder larger than 3 μm, so that precise fine powder classifying cannot be done.

It is desirable that this T/P be 0.60 or less, but from the present technology, in the event of executing precise fine powder classifying, for example, cutting out 3 μm, it is known that thickness of T being T/P of 0.1~0.5 is sufficient.

It is desirable that the rotor aperture area M be 40% or greater than 40%, as, in all respects of structural aspects, mechanical strength and precise fine powder classifying, the larger possible, the less pressure loss there is within the classifier.

Next, explanation concerning the operation of the embodiment will be explained. Classifying air is sent from the classifying air supply passage 11 via the guide vanes 8 to the classifying chamber 7, the rotary shaft 4 is rotated causing the vortex flow adjustment vanes 6 to rotate, and the vortex is formed within the said classifying chamber 7.

As a result of this, the air flow circulates through the classifying chamber 7, passes between the vortex flow adjusting vanes 6, and is discharged from the product discharge duct 12 to the exterior of the machine.

In this condition, when material to be classified Y (raw material), calcium carbonate, for example, is put in through the raw material inlet 13, the said material to be classified collides with the dispersion plate 14 and disperses toward the circumferential direction while falling to the classifying chamber 7.

As a result of this, this raw material Y is borne by the air flow, and at the same time the powerful shearing force of the air flow breaks the strong agglomeration into single particles, and further is taken into the high-speed vortex flow of the ideal vortex slope without occurrence of lag. Then, the said particles are classified by the action of the balance between the centrifugal force and the drag force. This classified fine powder Y2, for example particle diameter 5 μm or less, while being borne on the updraft and passing through the inside of rotor 5 and flowing into the product discharge duct 12, enters the unspecified air filtration mechanism and is recovered.

Also, the coarse powder Y1 falls through hopper 2 while circling through the inside of casing 1, and is discharged from the coarse powder discharge duct 3.

Figure 3:
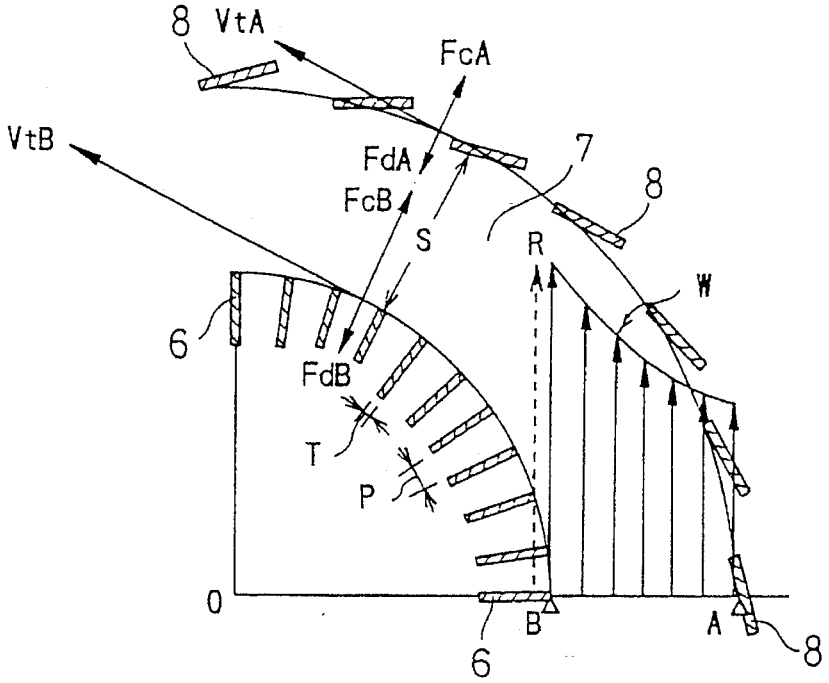
FIG. 3 is a figure to show the action of this invention.
Figure 4:
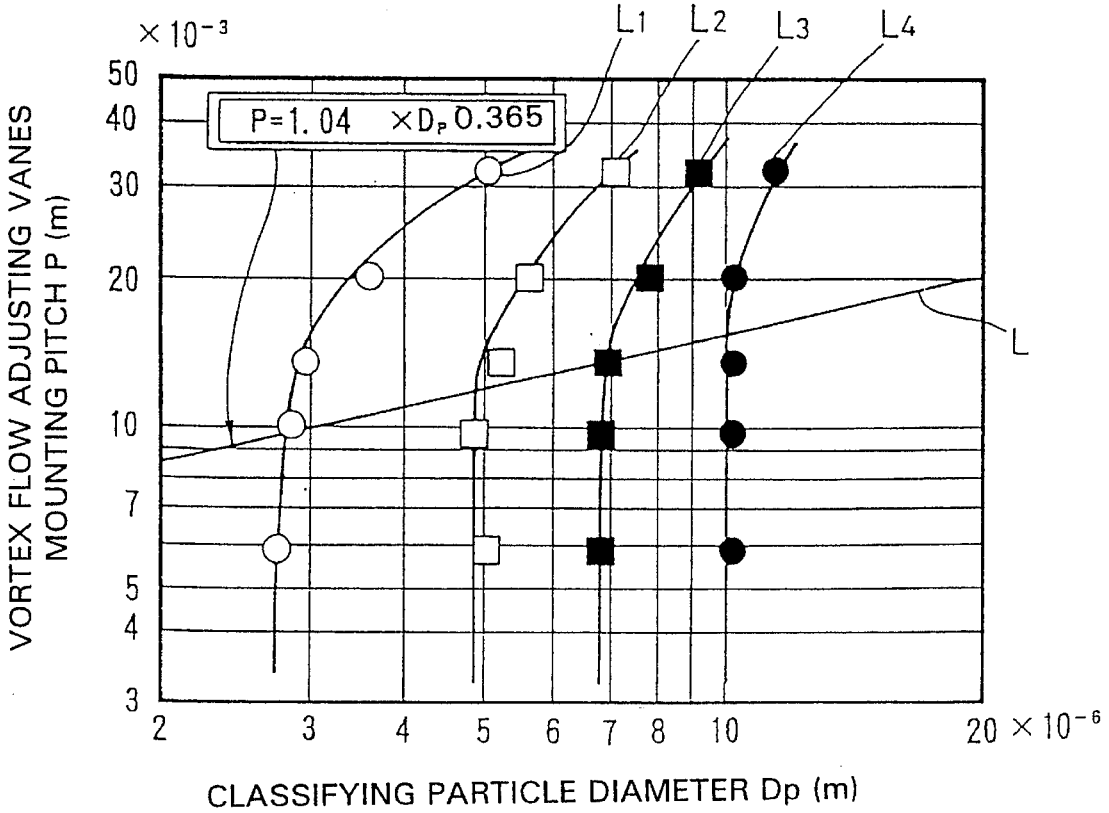
FIG. 4 is a figure which shows the relation between the mounting pitch and the classifying particle diameter.
Figure 6:
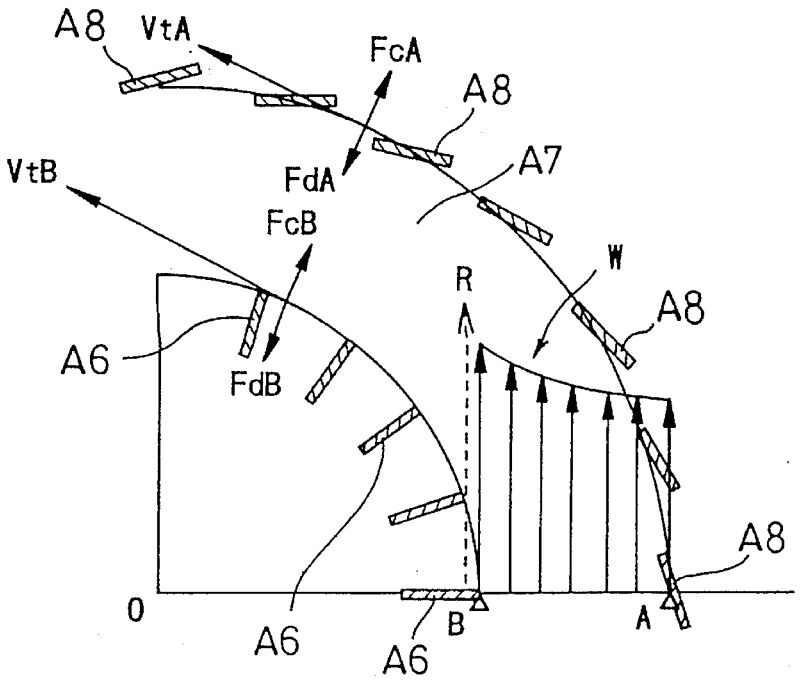
FIG. 6 is a diagram which shows a conventional example.
Figure 7:
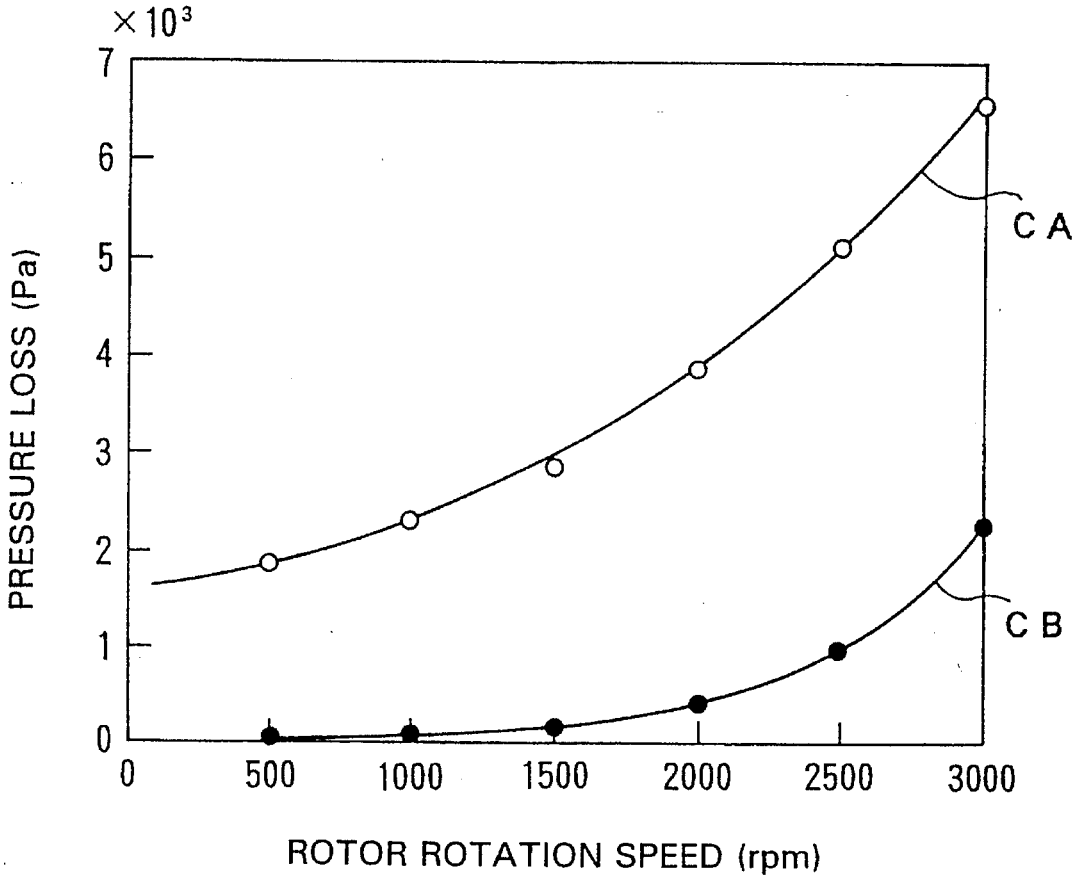
FIG. 7 is a diagram which shows the pressure loss of the entire classifier and the pressure loss of the outside of the rotor blade perimeter.

The tangential direction flow speed distribution of the vortex within the vortex pneumatic classifier of this invention is as shown in FIG. 3, but upon comparison with the conventional example of FIG. 6, in FIG. 3 the rotor speed R in the vicinity of the vortex flow adjusting vanes 6 and the tangential direction flow speed distribution of the vortex W are the same. Owing to this, unlike the conventional situation, the classifying particle diameter from actual separation is almost the same as the theoretical classifying particle diameter, so that precise classifying can be conducted at the desired classifying point.

The embodiments of this invention are not limited to the said, for example, instead of providing the product discharge duct of the vortex pneumatic classifier at the top of the said classifier, providing it at the bottom, or, providing the raw material inlet at the top center of the classifier and providing the product discharge duct at the bottom, or, further, introducing the raw material inlet to the side or at the bottom of the classifying apparatus with the classifying air, etc., it can be applied to various types of rotor type classifiers.

Figure 5:
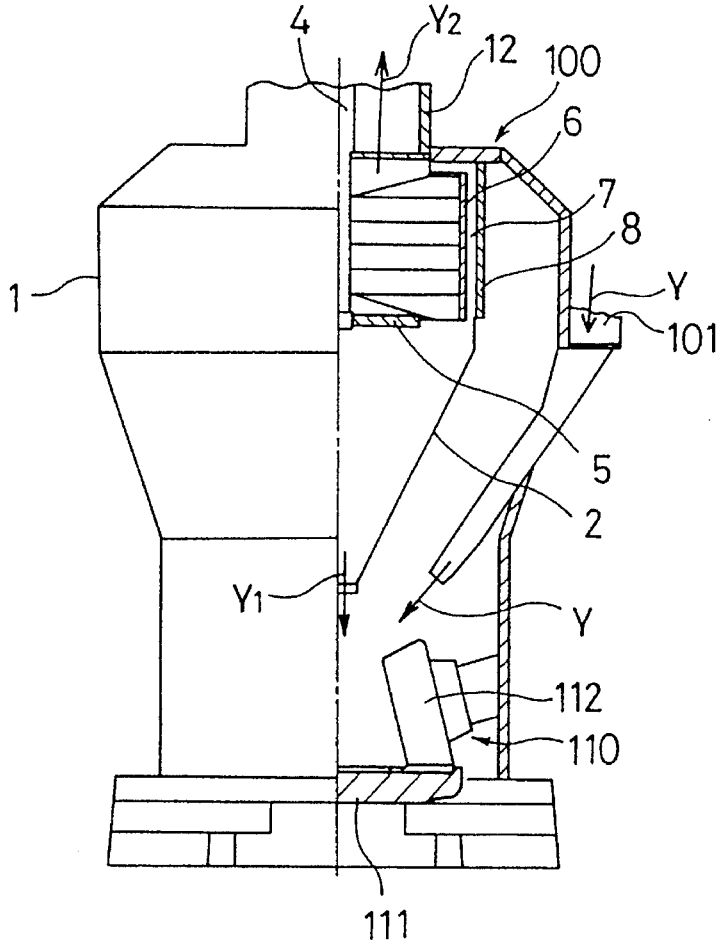
FIG. 5 is a partial cross-sectional front view which shows another embodiment of this invention.

Also, as with a vertical type mill shown in FIG. 5, the vortex pneumatic classifier 100 of this invention and the mill 110 can be combined. In FIG. 5, 101 represents the raw material inlet to supply material to be pulverized Y onto a table 111, and 112 represents a roller.

Figure 2:
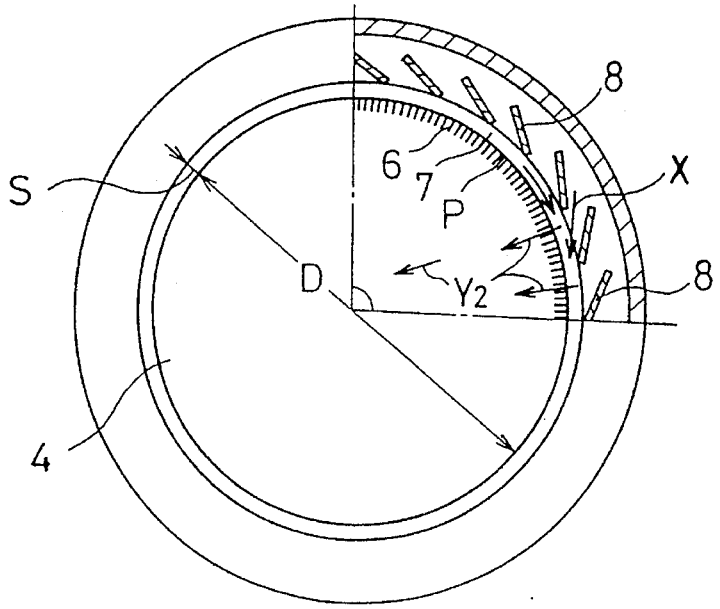
FIG. 2 is a cross-sectional diagram of the II—II Line of FIG. 1.
Figure 8:
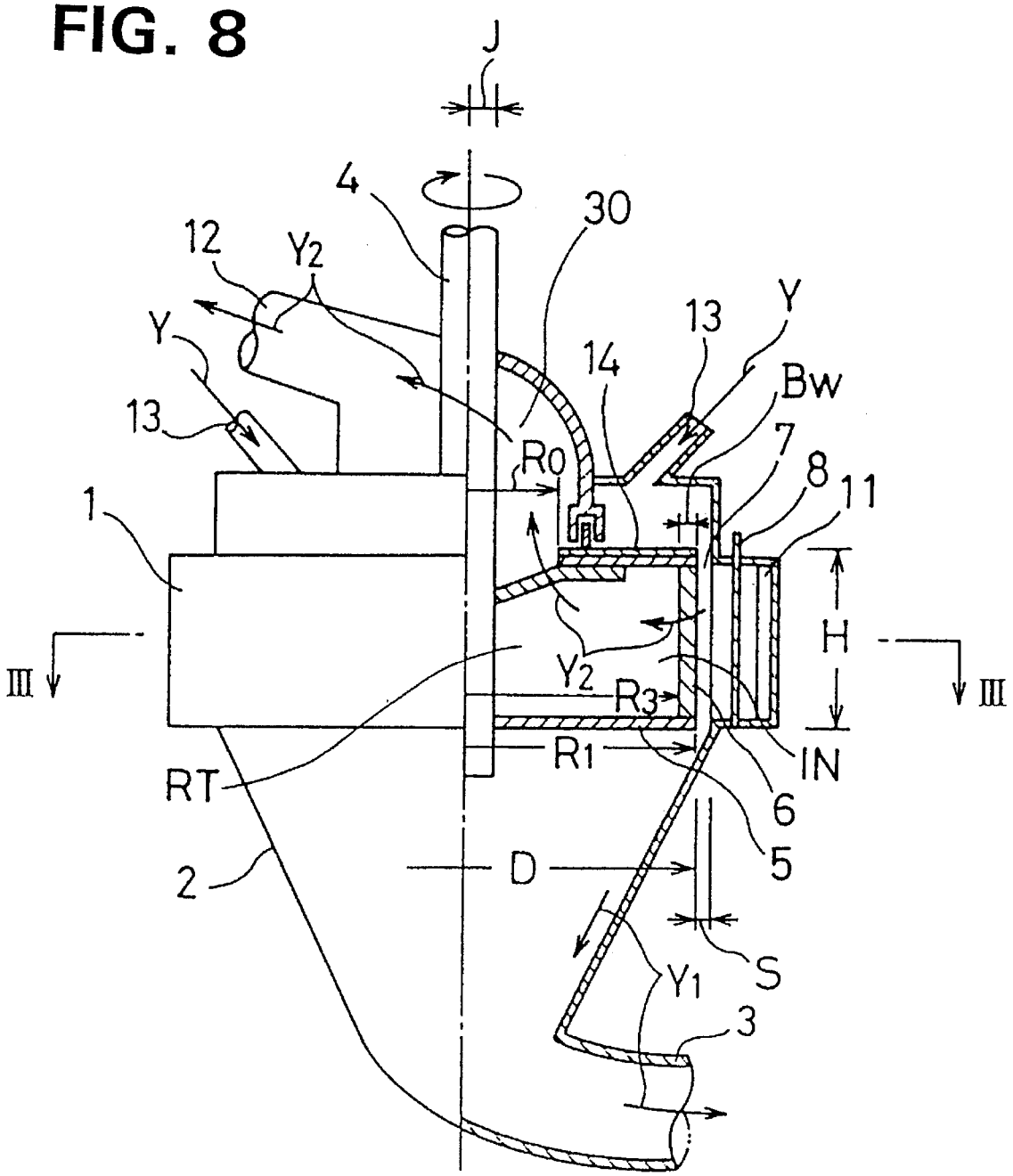
FIG. 8 is a partial cross-sectional front view of the classifier which shows the 2nd embodiment of this invention.
Figure 9:
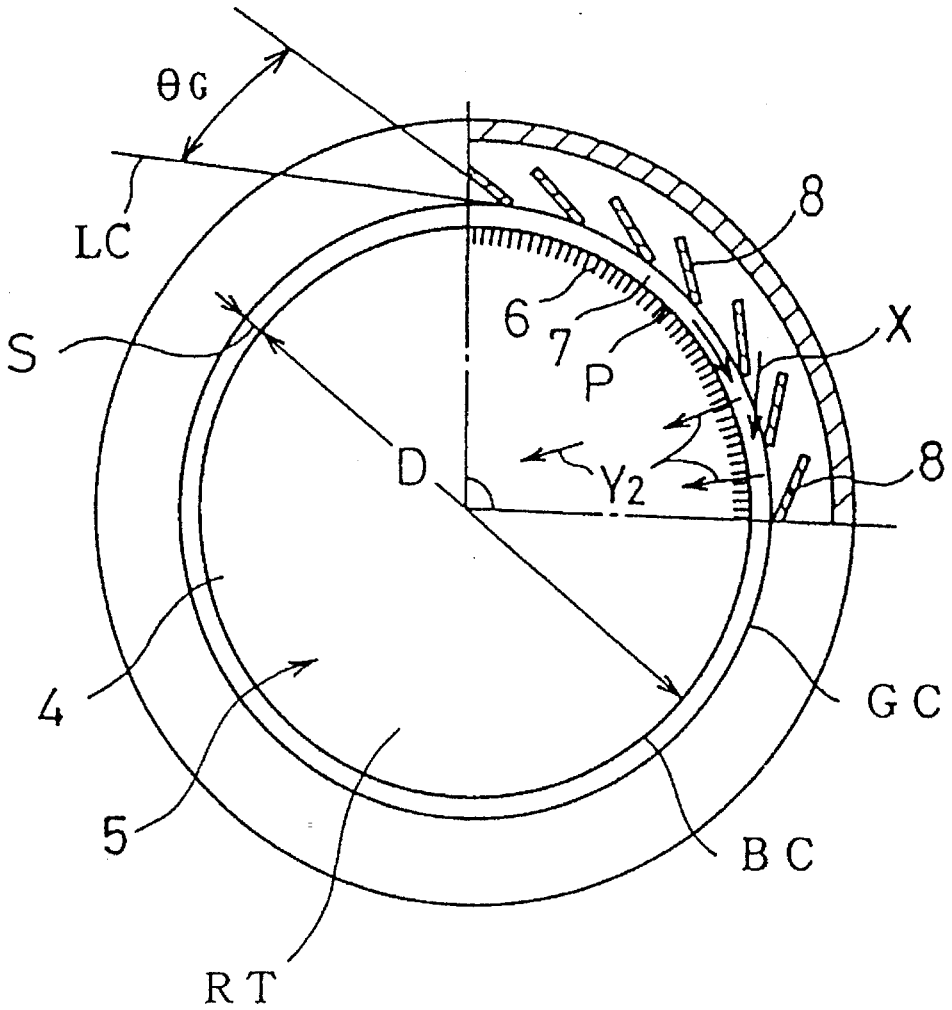
FIG. 9 is a cross-sectional diagram of the III—III Line of FIG. 8.
Figure 10:
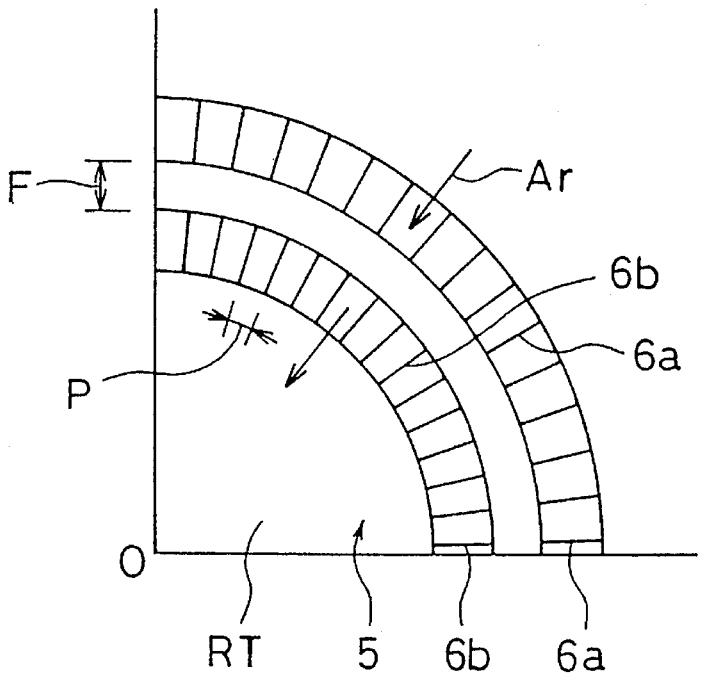
FIG. 10 is a diagram which shows the 3rd embodiment of this invention.

The 2nd embodiment of this invention is explained with FIG. 8~FIG. 10, the names and functions of the same drawing symbols are the same as with FIG. 1~FIG. 3.

A conical hopper 2 is provided at the lower portion of the cylindrical casing 1, and the lower portion of the said hopper 2 is made to communicate with the coarse powder discharge duct 3.

In the center of the interior of the casing 1, a rotor 5 is positioned being secured to the rotational axis 4. The diameter of this rotor 5 is D, and the height thereof is H.

A plurality of rotor blades (vortex flow adjusting vanes) 6 are provided at the perimeter of the rotor 5, and the mounting pitch thereof is obtained by the following expressions (1) or (4) as mentioned in the 1st embodiment.

$$P \leqq 1.04 \times Dp(th)^{0.365} \quad (1)$$

$$P^{2.74} \leqq 1.11 \sqrt{18\mu/2(\rho p \pi H)} \cdot \sqrt{Q}\ /Vt \quad (4)$$

As mentioned in the 1st embodiment, the width S of this classifying chamber 7 is extremely important, and an appropriate value can be determined with the following expression (5) obtained by the 1st embodiment:

$$S = K\sqrt{P} \quad (5)$$

The determination of the circumferential direction thickness T of the rotor blade 6 is also important. The ratio T/P between the pitch P (m) and the thickness T of the circumferential direction of the vortex flow adjusting vanes 6 is made to be 0.60 or less, and the aperture area M of rotor 5 is formed at 40% or greater. According to the experiments, the circumferential direction thickness T of the rotor blade 6 and the aperture area M of the rotor 5 are also extremely important, and T and M here are determined in the same way as with the 1st embodiment.

In order to form a forced vortex inside the rotor without forming a Burgers vortex, the length of the rotor radial direction length Bw, i.e., the length of the rotor blade outer perimeter radius R1 from which the rotor blade inner perimeter radius R3 has been subtracted, is, as has been found according to the experiments, optimal at a range of 0.7~1.0 times the difference between the rotor blade outer perimeter radius R1 and radius R0 of the discharge duct 30 of the rotor chamber RT.

Next, explanation concerning the operation of the 2nd embodiment will be explained. Classifying air is sent from the classifying air supply passage 11 via the guide vanes 8 to the classifying chamber 7, the rotary shaft 4 is rotated causing the vortex adjustment vanes 6 to rotate, and the vortex is formed within the said classifying chamber 7.

As a result of this, the air flow circulates through the classifying chamber 7, passes between the rotor blades 6 of the inlet IN of the Rotor chamber RT and is changed to an upward flow, and, passing through the exhaust duct 30 is discharged from the discharge duct (product discharge duct) 12 to the exterior of the machine.

In this condition, when material to be classified Y (raw material), calcium carbonate, for example, is put in through the raw material inlet 13, the said material to be classified collides with the dispersion plate 14 and disperses toward the circumferential direction while falling to the classifying chamber 7.

During this, the particles of the classifying material are accelerated by the vortex and circle within the classifying chamber. At this time, the particles are dispersed by the shearing force of the vortex and the resulting collision friction between the particles, and the particles smaller than the classifying particle diameter determined by the balance between the centrifugal force and air drag force reach the outer perimeter of the rotor blade.

This classified fine powder Y2, for example particle diameter 5 μm or less, while passing through the rotor chamber RT and being borne on the updraft and flowing into the product discharge duct 12, enters the unspecified air filtration mechanism and is recovered.

At this time, as said, as a result of being 0.7~1.0 times the difference between the rotor blade outer perimeter radius R1 and radius R0 of the discharge duct 30 of the rotor chamber RT, the air flow within the rotor chamber RT becomes a forced vortex without forming a Burgers vortex, so that the pressure loss within the rotor chamber drops drastically.

Also, the coarse powder Y1 falls through hopper 2 while circling through the inside of classifying chamber 7, and is discharged from the coarse powder discharge duct 3.

The 3rd embodiment of this invention is explained from FIG. 10. The characteristic of this embodiment is that the rotor blade is divided in the rotor radius direction and rotor blades 6*a* and 6*b* are positioned, and spacing F is provided between the rotor blades 6*a* and 6*b* to an extent to where the forced vortex is not disturbed. With this embodiment, the pressure loss owing to the friction between the surface of the rotor blades 6*a* and 6*b* and the fluid matter can be further reduced.

Figure 11:
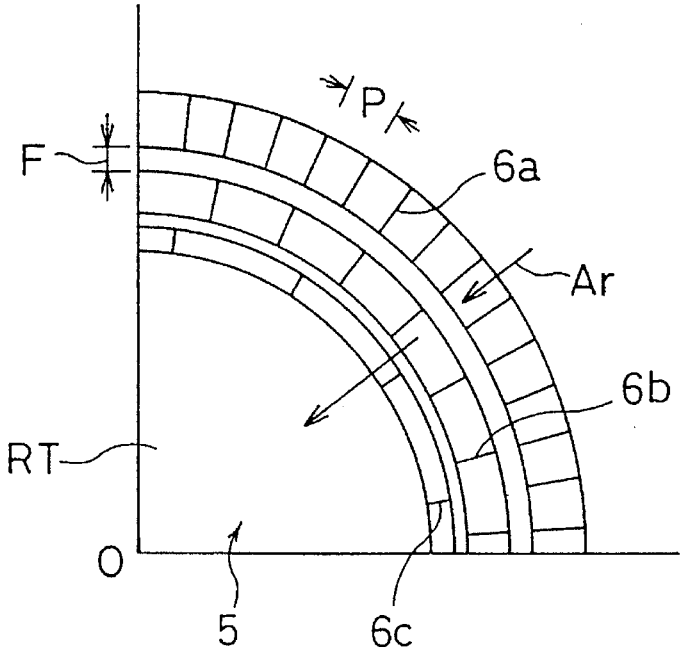
FIG. 11 is a diagram which shows the 4th embodiment of this invention.

The 4th embodiment of this invention is explained from FIG. 11. The characteristic of this embodiment is that in the case that the number of rotor blades 6*a*, 6*b* and 6*c* in the circumferential direction are great and the pitch P is small, the number of the rotor blades 6*a*, 6*b* and 6*c* are decreased uniformly as headed toward the rotor center 0, to an extent to where the forced vortex is not disturbed. With this embodiment, the pressure loss owing to the friction between the surface of the rotor blades and the fluid matter can be further reduced, and, at the same time, mechanical manufacturing of the rotor blades becomes easier, making for less weight and manufacturing cost.

Figure 12:
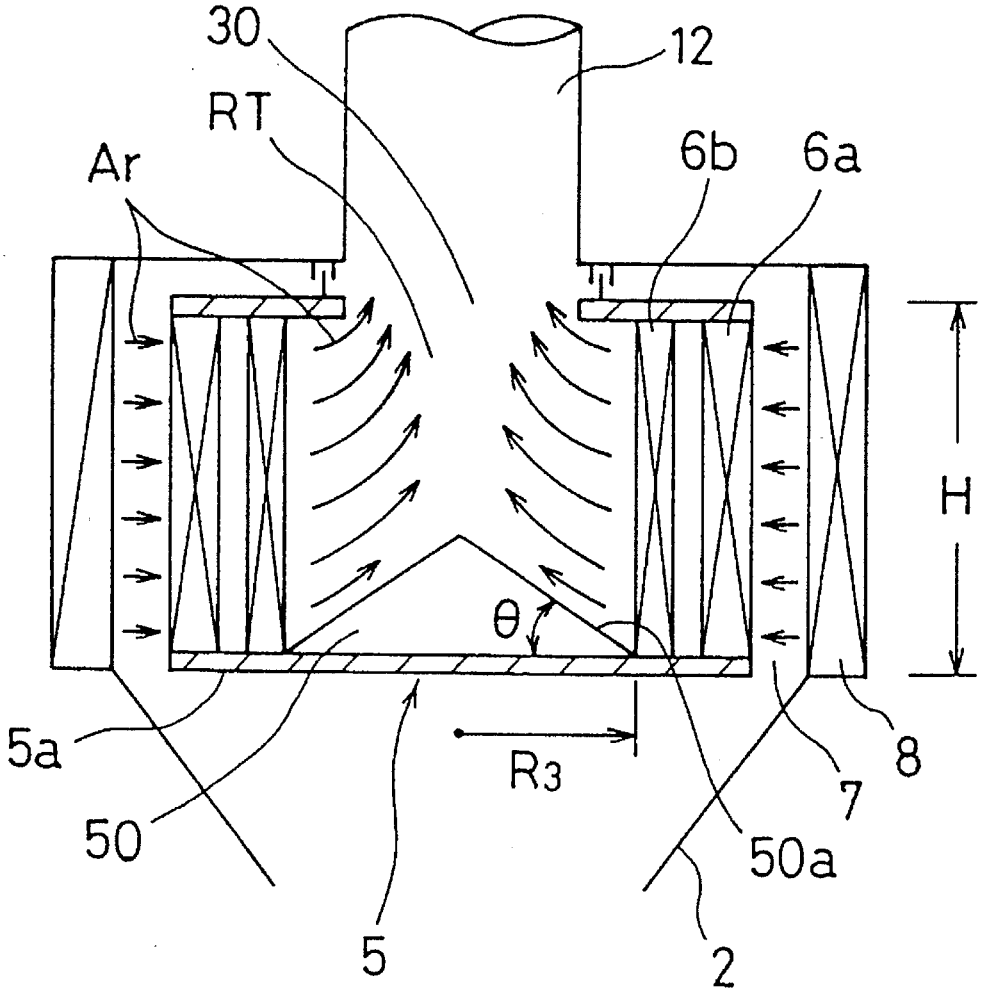
FIG. 12 is a diagram which shows the 5th embodiment of this invention.

The 5th embodiment of this invention is explained from FIG. 12. The characteristic of this embodiment is that a raised formation 50 which rises from the inscribed circle radius R3 of the inner rotor blade 6*b* is formed on the bottom surface 5*a* of the rotor B of the rotor chamber RT. This raised formation 50 is formed in a conical form, but the angle of the slant face (generating line) 50*a* of this raised formation 50 against the base surface 5*a*, i.e., the rise angle θ must not be too large or too small. Here, as the result of experimentation, it has been found that the angle θ obtained from the following expression from the relation between the height H of the rotor $$\theta=\tan^{-1}\{(0.3\sim0.6)H/R3\} \quad (6)$$

With this embodiment, the air Ar which is circling inside the classifying chamber 7 in a horizontal manner passes between the rotor blades 6*a* and 6*b*, and guided by the raised formation 50, changes direction, and passing through the exhaust duct 30 of the rotor chamber RT, is discharged from the product discharge duct 12. As a result, the air Ar flows smoothly without stagnation, lessening pressure loss.

The 6th embodiment of this invention is explained from FIG. 8. The characteristic of this embodiment is that the radius R0 of the exhaust duct 30 of the rotor chamber RT has been expanded to 0.4~0.8 times the rotor blade 6 outer perimeter radius R1. With this embodiment, the ratio of air nearing the rotor central axis is reduced, making for lessening of pressure loss.

The 7th embodiment of this invention is explained. The characteristic of this embodiment is that the radius J of the rotary shaft 4 of the rotor 5 has been enlarged to 0.2~0.4 times the rotor blade outer perimeter radius R1. With this embodiment, the ratio of air nearing the rotor central axis is reduced, making for lessening of pressure loss.

The 8th embodiment of this invention is explained. The characteristic of this embodiment is that the said 2nd embodiment through the 7th embodiment are suitably combined. For example, the 5th embodiment of FIG. 12 and the 3rd embodiment of FIG. 10, the 4th embodiment of FIG. 11, or the 7th embodiment are combined together, or further, the 7th embodiment and the 3rd embodiment of FIG. 10, or the 4th embodiment of FIG. 11 are combined. By combining suitable embodiments in this way, a classifier with even less pressure loss can be obtained.

The embodiments of this invention are not limited to the said, for example, instead of providing the product discharge duct of the rotor chamber of the vortex pneumatic classifier at the top of the said classifier, providing it at the bottom, or, providing the raw material inlet at the top center of the classifier and providing the exhaust duct at the bottom of the rotor chamber, or, further, introducing the raw material inlet to the side or at the bottom of the classifying apparatus with the classifying air, etc., it can be applied to various types of rotor type classifiers.

As this invention has been configured in this way, there is no great pressure loss in the rotor chamber. As a result, the pressure loss of the entire classifier is greatly reduced in comparison with the conventional example. Also, as the fan which conducts suction of air bears a great ratio of the energy required for the vortex pneumatic classifier, and as the energy required for the fan is proportional to the pressure loss, the power of the fan can be reduced by several ten % in comparison with the conventional example.

Figure 13:
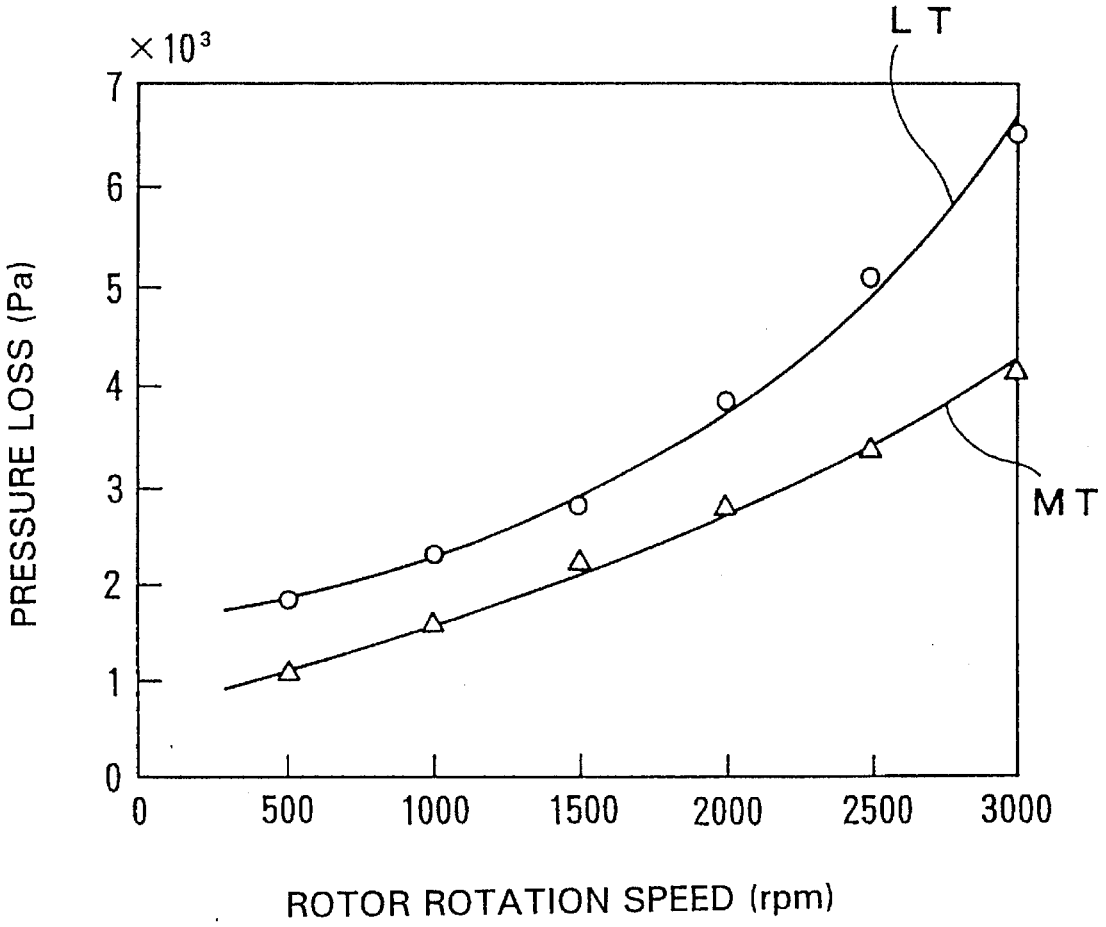
FIG. 13 is a diagram which shows the pressure loss of this invention and that of the conventional example.
Figure 14:
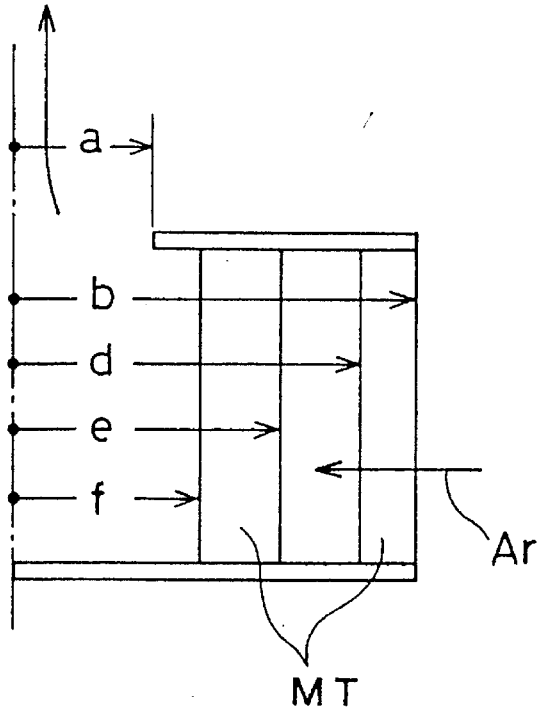
FIG. 14 is a diagram which shows the rotor blade of this invention used in the experiment of FIG. 13.
Figure 15:
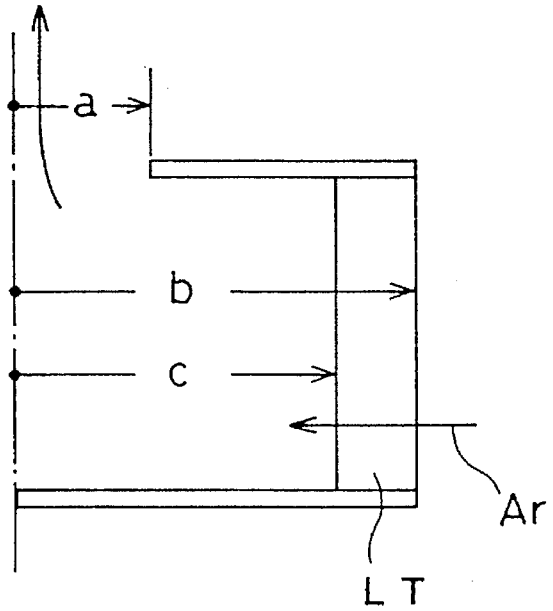
FIG. 15 is a diagram which shows the rotor blade of the conventional example used in the experiment of FIG. 13.

Accordingly, rotor blades of this invention MT shown in FIG. 14 and of the conventional example LT shown in FIG. 15 were configured, and upon conducting pressure loss experiment, the results of FIG. 13 were obtained. As apparent from FIG. 13, the pressure loss with this invention MT becomes approximately 65% of the conventional example LT, and as the rotor speed increases, the difference between both LT and MT increased. Further, in FIG. 14 and FIG. 15, "a" represents the 122 mm exhaust duct radius, "b" represents the 205 mm rotor blade outer perimeter radius, "c" represents the 189 mm rotor blade inner perimeter radius, "d" represents the 195 mm outer rotor blade inner perimeter radius, "e" represents the 165 mm inner rotor blade outer perimeter radius, "f" represents the 150 mm inner rotor blade inner perimeter radius. Of course, the classifying air flow rate was the same in both experiments.

Figure 16:
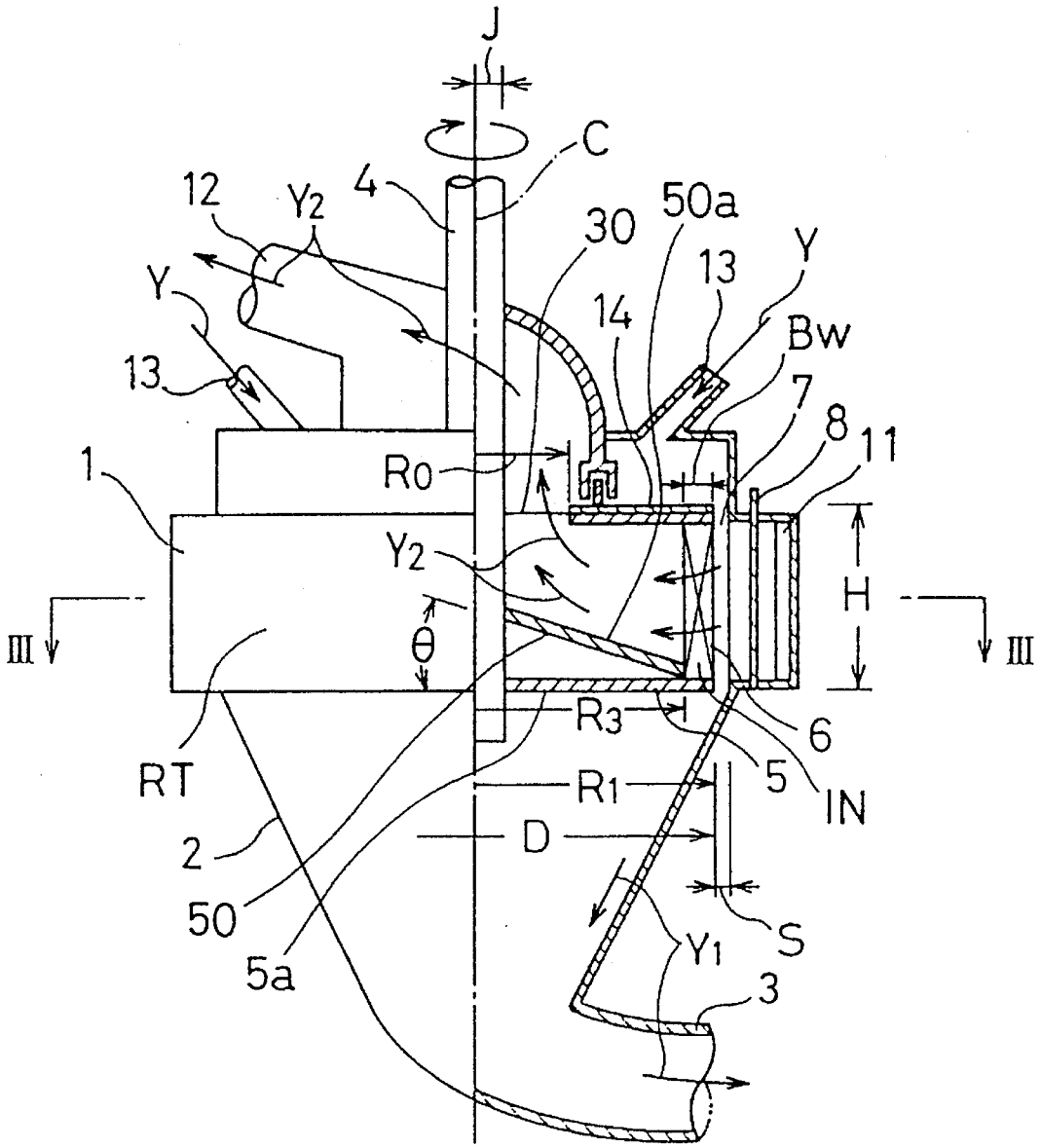
FIG. 16 is a partial cross-sectional diagram of the front view of the classifier which shows the 9th embodiment of this invention.

The 9th embodiment of this invention is explained with FIG. 16, the names and functions of the same drawing symbols are the same as with FIG. 1~FIG. 3. A conical hopper 2 is provided at the lower portion of the cylindrical casing 1, and the lower portion of the said hopper 2 is made to communicate with the coarse powder discharge duct 3.

In the center of the interior of the casing 1, a rotor 5 is positioned being secured to the rotational axis 4. The diameter of this rotor 5 is D, and the height thereof is H.

Within the rotor chamber RT is provided a flow straightening member which is concentrical with the rotational axis 4. This member is formed on the bottom surface 5*a* of the rotor 5 of the rotor chamber and is the raised formation 50 which rises from the inside circle radius R3 of the rotor blade 6. This raised formation 50 is formed in a conical form, but the angle of the slant face (generating line) 50*a* of this raised formation 50 against the base surface 5*a*, i.e., the rise angle θ is, as stated in the said 5th embodiment, determined by the following expression (6).

$$\theta=\tan^{-1}\{(0.3\sim0.6)H/R3\} \quad (6)$$

A plurality of rotor blades (vortex flow adjusting vanes) 6 are provided at the perimeter of the rotor 5, and the mounting pitch P thereof is obtained by the following expressions (1) or (4) as mentioned in the 1st embodiment.

$$P \leqq 1.04 \times Dp(th)^{0.365} \quad (1)$$

$$P^{2.74} \leqq 1.11\sqrt{18\mu/2\rho p\pi H}\cdot\sqrt{Q}/Vt \quad (4)$$

As mentioned in the 1st embodiment, the width S of this classifying chamber 7 is extremely important, and an appropriate value can be determined with the following expression (5) obtained by the 1st embodiment.

$$S=K\sqrt{P} \quad (5)$$

Determination of the circumferential direction thickness T of the rotor blade 6 and the aperture area M of the rotor are also important, and T and M here are determined in the same way as with the 1st embodiment.

In order to form a forced vortex without forming a Burgers vortex, the length of the rotor radial direction length Bw of the rotor blade 6, i.e., the length of the rotor blade outer perimeter radius R1 from which the rotor blade inner perimeter radius R3 has been subtracted, is, as with the 1st embodiment, determined within a range of 0.7~1.0 times the difference between the rotor blade outer perimeter radius R1 and radius R0 of the discharge duct 30 of the rotor chamber RT.

Next, explanation concerning the operation of the embodiment will be explained. Classifying air is sent from the classifying air supply passage 11 via the guide vanes 8 to the classifying chamber 7, the rotary shaft 4 is rotated causing the vortex adjustment vanes 6 to rotate, and the vortex is formed within the said classifying chamber 7.

As a result of this, the air flow circulates through the classifying chamber 7, passes between the rotor blades 6 of the inlet IN and enters the rotor chamber 8T and circulates, and, having been changed to an upward flow guided by the rising formation 50, passes through the exhaust duct 30 and is discharged from the discharge duct 12 to the exterior of the machine.

In this condition, when material to be classified Y (raw material), calcium carbonate, for example, is put in through the raw material inlet 13, the said material to be classified collides with the dispersion plate 14 and disperses toward the circumferential direction while falling to the classifying chamber 7.

During this, the particles of the classifying material are accelerated by the vortex and circle within the classifying chamber. At this time, the particles are dispersed by the shearing force of the vortex and the resulting collision friction between the particles, and the particles smaller than the classifying particle diameter determined by the balance between the centrifugal force and drag force reach the outer perimeter of the rotor blade.

This classified fine powder Y2, for example particle diameter 5 μm or less, while passing through the rotor chamber RT and being borne on the updraft and flowing into the product discharge duct 12, enters the unspecified air filtration mechanism and is recovered.

At this time, as a result of the air flow direction within the rotor chamber RT being smoothly changed while being restricted by the rising formation 50, the pressure loss within the rotor chamber drops drastically.

Also, the coarse powder Y1 falls through hopper 2 while circling through the inside of classifying chamber 7, and is discharged from the coarse powder discharge duct 3.

Figure 17:
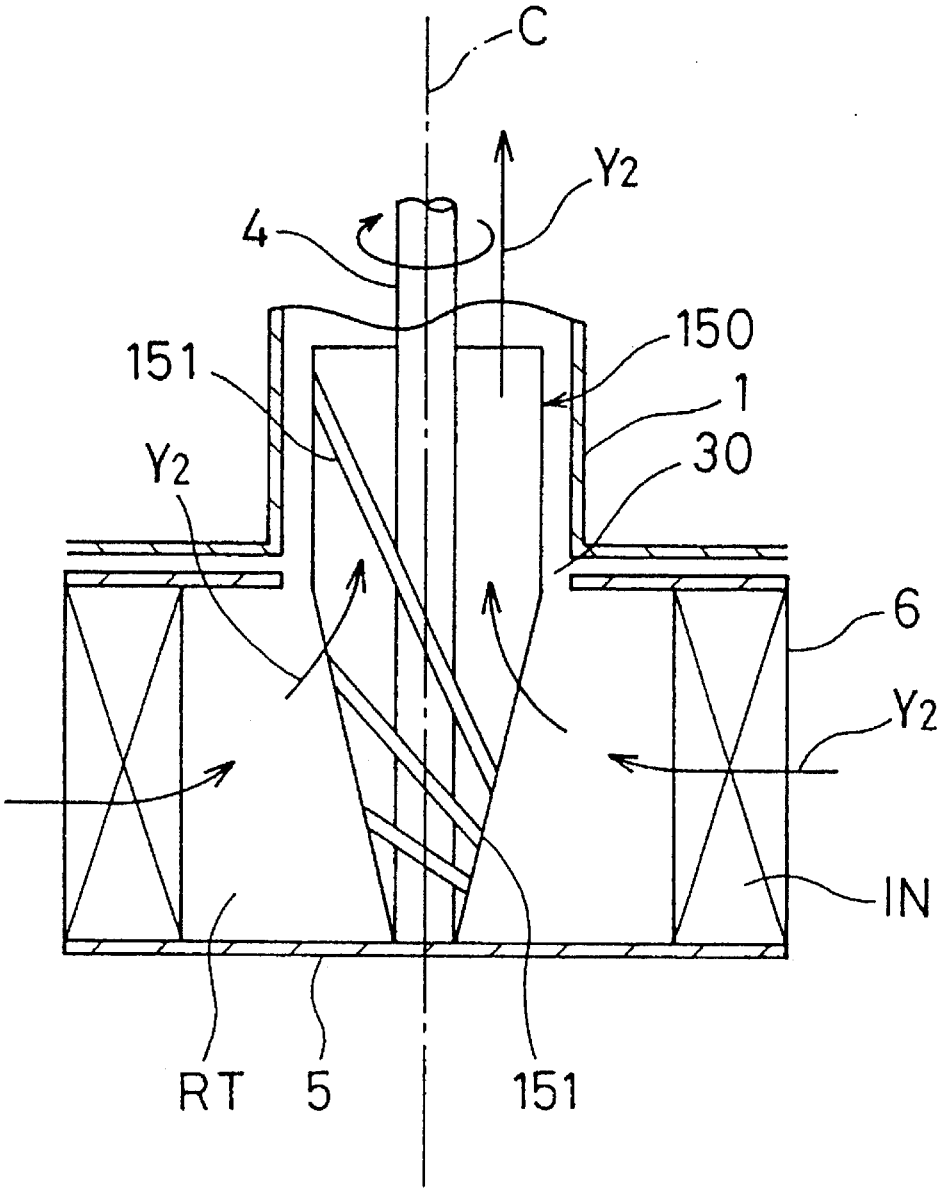
FIG. 17 is a vertical cross-sectional diagram which shows the 10th embodiment of this invention.
Figure 18:
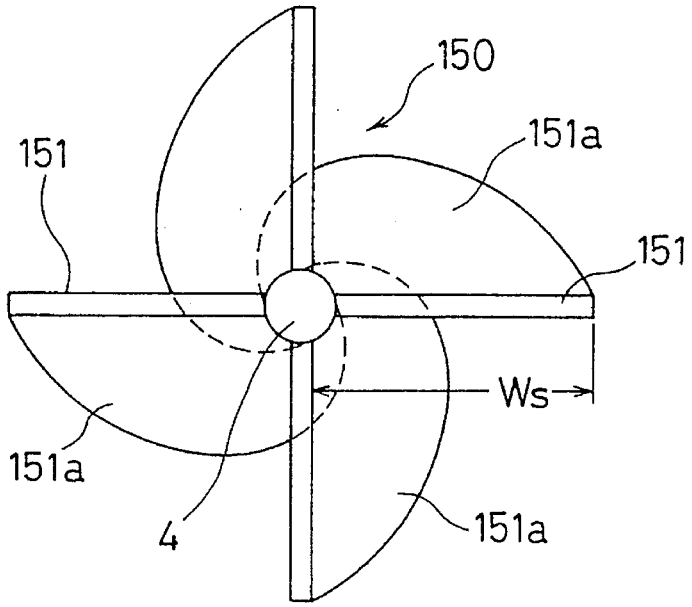
FIG. 18 is a close-up top view of the flow-straightening vanes of the 10th. embodiment.
Figure 19:
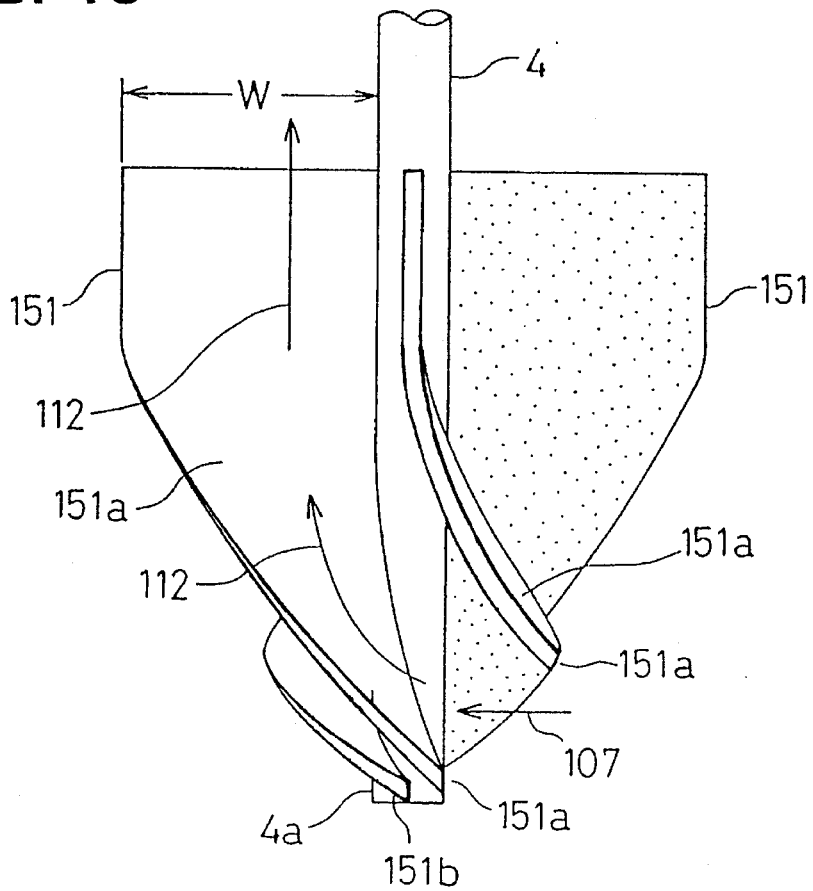
FIG. 19 is a close-up front view of the flow-straightening vanes of the 10th embodiment.

The fourth embodiment of this invention is explained with FIG. 17~FIG. 19. The characteristic of this embodiment is that a flow-straightening vane 150 is used as a flow-straightening member. This flow-straightening vane 150 is secured concentrically to the rotary shaft 4 of the rotor which passes through the rotor chamber RT, and the flow-straightening vane 150 is comprised of 4 plane-shaped flow-straightening plates 151.

Each of these flow-straightening plates is in an inverse triangular form, and while the surfaces 151*a* are positioned in a direction to where they oppose the circulating flow 107, and beginning with being horizontal at the bottom gradually approaches becoming vertical toward the top, and, at least at the lower half, is of a spiral shaped curved plane form.

Also, the width W of the said flow-straightening plates 151 gradually becomes narrower toward the bottom, and finally the width of the bottom end 151*b* of the said flow-straightening plates 151 becomes zero, and becomes the same diameter as the rotary shaft 4.

In this embodiment, the circulating flow 107 which has flowed in through the inlet of the rotor chamber RT has its flow direction restricted by the plane-shaped flow-straightening plates 151 and is changed to the upward flow 112, and is discharged from the exhaust duct 30. As the direction conversion of the flow at this time is conducted in a smooth manner, there is little pressure loss.

Figure 20:
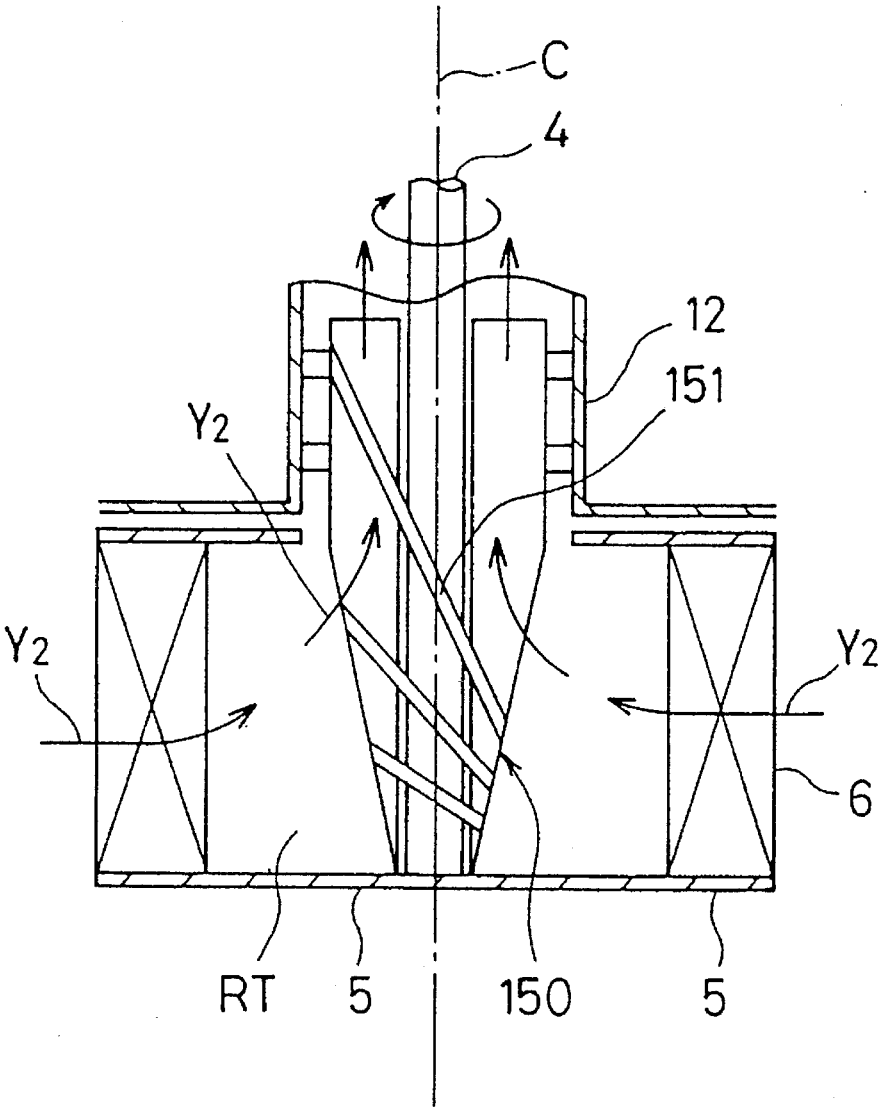
FIG. 20 is a vertical cross-sectional diagram which shows the 11th embodiment of this invention.

The 11th embodiment of this invention is explained with FIG. 20. The difference between this embodiment and the 10th embodiment is that the flow-straightening vane 150 is fitted over the rotary shaft 4 of the rotor without being fixed, and, is fixed to the exhaust duct 12. In this embodiment the flow-straightening vane 150 does not rotate, but the flow-straightening effect is greater than with the said 10th embodiment.

Figure 21:
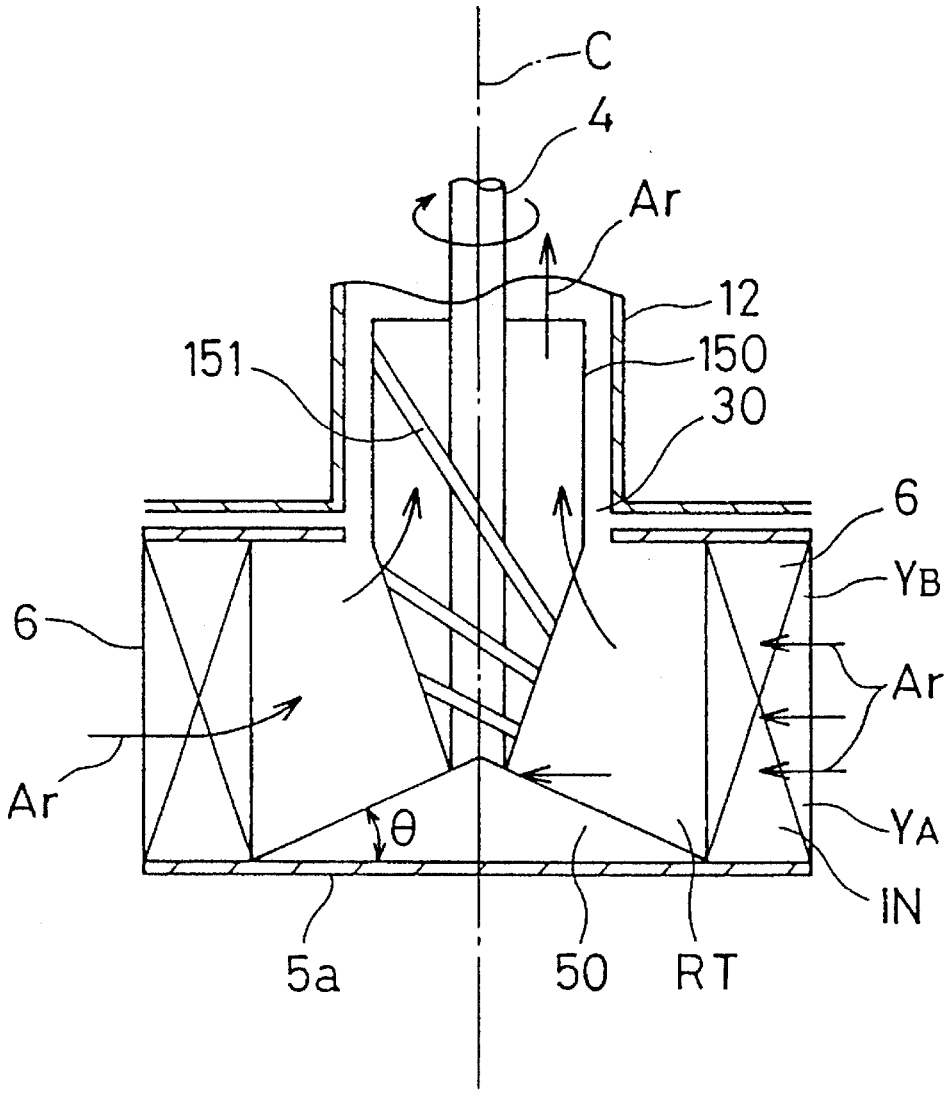
FIG. 21 is a vertical cross-sectional diagram which shows the 12th embodiment of this invention.

The 12th embodiment of this invention is explained with FIG. 21. This embodiment is a combination of the 9th embodiment and the 10th embodiment. A raised formation 50 of rise angle θ is formed on the bottom surface 5*a* of the rotor 5 of the rotor chamber RT, and a flow-straightening vane 150 is secured concentrically to the rotary shaft 4 of the rotor above.

Generally, fluid matter which flows into the inlet IN of the rotor differs in stream line position depending on the position of flowing in through the inlet IN. i.e., air Ar which enters from the lower portion YA of the inlet IN rises while circling close to the rotary shaft 4 of the rotor, while air Ar which enters from the upper portion YB of the inlet rises while circling close to the wall of the exhaust duct 12, but these never meet.

With the flow-straightening member of this embodiment, these fluid material properties are faithfully followed, and as there is no unnecessary circulation applied, nor stagnation created, the pressure loss is lessened drastically.

Figure 22:
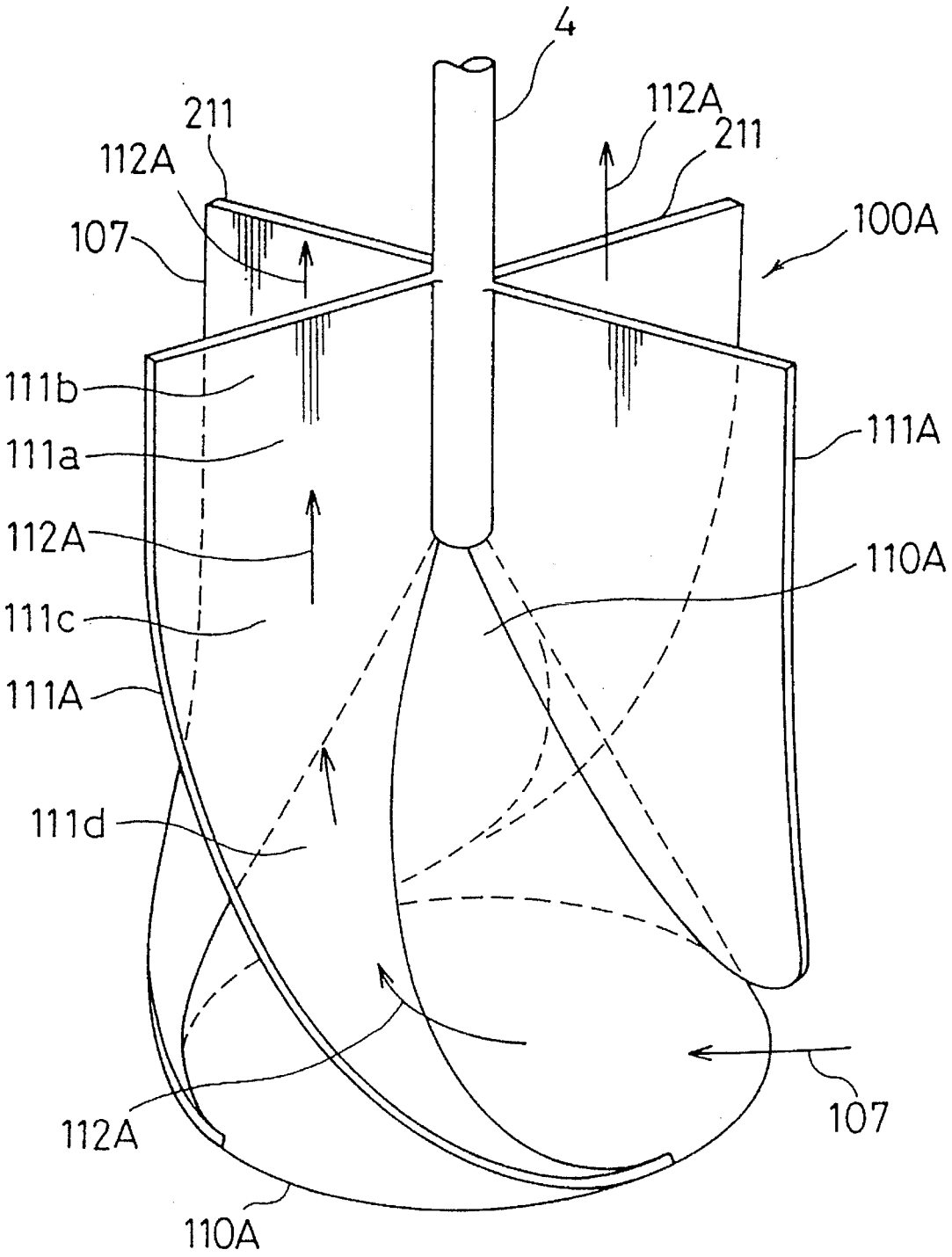
FIG. 22 is a perspective view diagram which shows the 13th embodiment of this invention.

The 13th embodiment of this invention is explained with FIG. 22. The difference between this embodiment and the 12th embodiment is that the flow-straightening member 100A is comprised of conical member 110A and plane-shaped flow-straightening plates 111A.

On the perimeter surface of this conical member 110A are provided a plurality of, preferably 4~6 flow-straightening plates 111A, are positioned in a direction to where their surfaces 111*a* oppose the circulating flow 107, and to where their longitudinal direction follows the vertical direction.

Also, the upper portion 111*b* of that each plane-shaped flow-straightening plate 111A is caused to protrude from the exhaust duct 30 of the rotor chamber RT. The other portion 111*c* of each plane-shaped flow-straightening plate 111A gently curves toward the upstream of the circulating flow 107 to form curved plane 111*d*.

With this embodiment, the circulating fluid material flowing in from the inlet IN of the rotor chamber is guided by the surface 111*a* of the curved plane 111*d*, and gradually is changed from the circulating flow 107 to the upward flow 112A. Upon this, the tangential speed which the circulating flow 107 has is converted to speed of only the axis direction, and in this condition, is discharged to the exterior of the machine from the exhaust duct 30.

Figure 23:
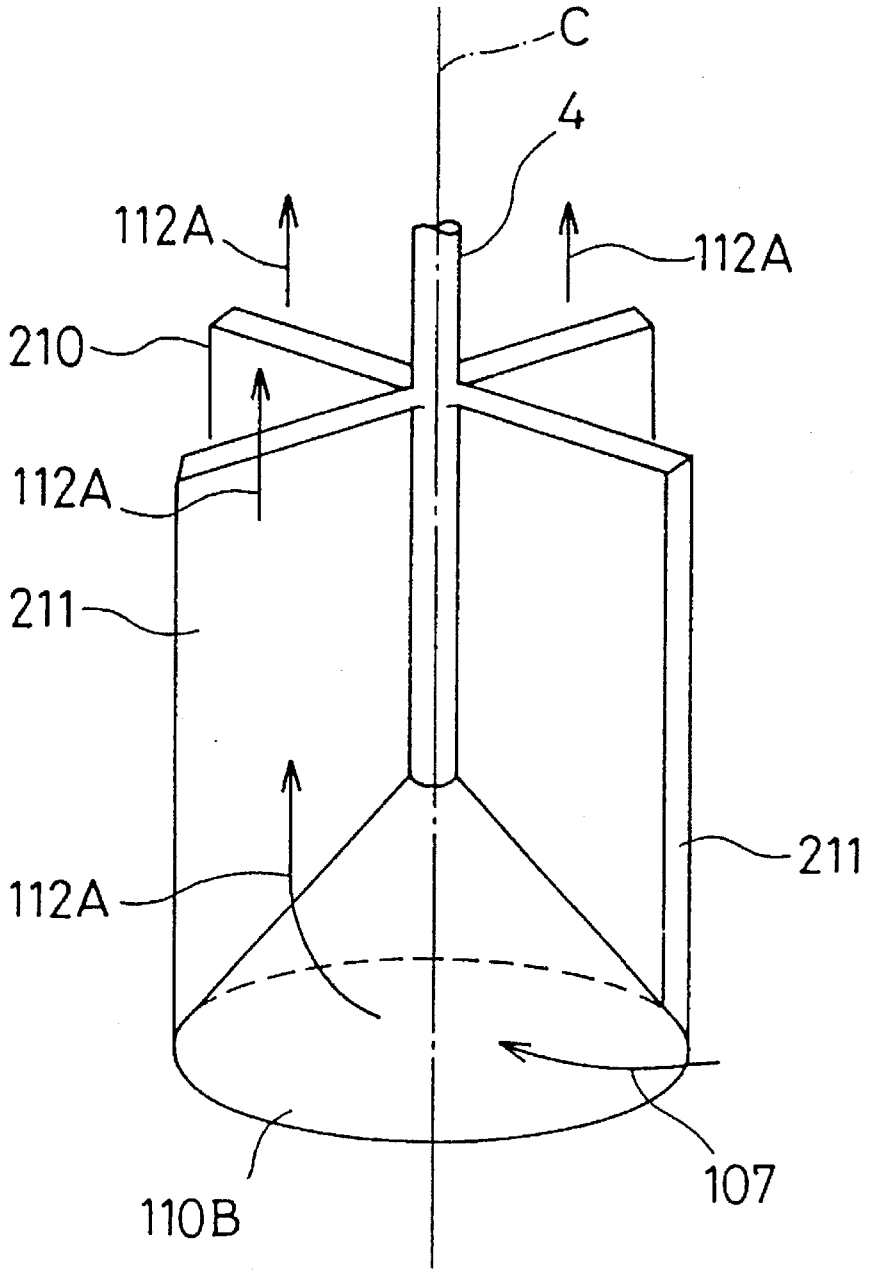
FIG. 23 is a perspective view which shows the 14th embodiment of this invention.

The 14th embodiment of this invention is explained with FIG. 23. The difference between this embodiment and the 13th embodiment is that the plane-shaped flow-straightening plate 211 of the flow-straightening vane 210 is vertically attached upon the conical member 110B, and the upper half of the said flow-straightening plate is secured to the rotary shaft 4, and the lower half is secured to the slanted surface of the conical member 110B in the direction of the generating line.

As this invention has in the said manner provided in the rotor chamber a flow-straightening member which is concentrical with the rotor rotary shaft, the fluid material flowing through the rotor chamber is smoothly changed in direction while heading toward the exhaust duct. As a result, there is no generation of great pressure loss within the rotor chamber, so that compared to the conventional example, the pressure loss of the entire apparatus declines greatly.

Also, as the fan which conducts suction of air bears a great ratio of the energy required for the vortex pneumatic classifier, and as the energy required for the fan is proportional to the energy loss, the power of the fan can be reduced by several ten % as compared to the conventional example.

INDUSTRIAL APPLICABILITY

As shown above, the vortex pneumatic classifier relating to this invention is suitable for use for classifying granular or powdered raw material, such as cement, calcium carbonate, ceramics, etc.

We claim:

1. A vortex pneumatic classifier comprising: a rotor, a plurality of vortex flow adjusting vanes provided on said rotor, a classifying chamber defined around said vortex flow adjusting vanes, and guide vanes radially opposing said vortex flow adjusting vanes on an opposite side of said classifying chamber, wherein a pitch (P) of said vortex flow adjusting vanes is determined in relation to a classifying particle diameter (Dp(th)) so as to meet the condition of $$P \leqq 1.04 \times Dp(th)^{0.365}.$$

2. A vortex pneumatic classifier comprising: a rotor, a plurality of vortex flow adjusting vanes provided on said rotor, a classifying chamber defined around said vortex flow adjusting vanes, and guide vanes radially opposing said vortex flow adjusting vanes on an opposite side of said classifying chamber, wherein a mounting pitch (P) of said vortex flow adjusting vanes is determined in relation to an air viscosity coefficient (μ), particle density (ρp), rotor height (H), classifying air flow rate (Q), and circumferential speed of said rotor at the tip of the vortex flow adjusting vanes (Vt) so as to meet the condition of $$p2.74 \leqq 1.11 \sqrt{18\mu/2(\rho p \pi H)} \cdot \sqrt{Q} / Vt.$$

3. A vortex pneumatic classifier according to claim 2, wherein a width (S) of said classifying chamber, said mounting pitch (P), and a constant (K) is determined so as to meet the condition of $$S = K\sqrt{P}.$$

4. A vortex pneumatic classifier according to claim 3, wherein said constant (K) is 5~20.

5. A vortex pneumatic classifier comprising: a rotor chamber with an inlet and an exhaust duct, a plurality of rotor blades placed at intervals circumferential around a rotor at said inlet of said rotor chamber, and a classifying chamber provided about a perimeter of said rotor chamber, wherein a radial direction length (Bw) of said plurality of said rotor blades is about 0.7~1.0 times the difference between a rotor blade outer perimeter radius (R1) and a radius of said exhaust duct (R0), and a radius of a rotor shaft (J) is about 0.2~0.4 times said rotor blade outer perimeter radius (R1), and a radius of said rotor chamber exhaust duct is 0.4~0.8 times an outer perimeter radius of said rotor blades.

6. A vortex pneumatic classifier comprising: a rotor chamber with inlet and exhaust ducts, a plurality of rotor blades placed at intervals circumferential around a rotor at said inlet of said rotor chamber, and a classifying chamber provided at a perimeter of said rotor chamber, wherein the radial direction length (Bw) of said plurality of said rotor blades is 0.7~1.0 times a difference between a rotor blade outer perimeter radius (R1) and a radius of said exhaust duct of said rotor chamber, and a rising formation provided on a base of said rotor for restricting air flow.

7. A vortex pneumatic classifier comprising: a rotor chamber with inlet and exhaust ducts, a rotor having a plurality of rotor blades disposed at intervals about a circumference of said rotor at said inlet, and a classifying chamber provided at a perimeter of said rotor chamber, wherein a radial direction length of said plurality of rotor blades is 0.7~1.0 times the difference between a rotor blade outer perimeter radius and a radius of said rotor chamber exhaust duct, and a radius of a rotor shaft is 0.2~0.4 times said rotor blade outer perimeter radius, and further, a rising formation provided on a base of said rotor for restricting air flow.

8. A vortex pneumatic classifier according to claim 7, wherein said rotor blades are spaced equidistantly from each other.

9. A vortex pneumatic classifier according to claim 8, wherein said plurality of rotor blades are provided at intervals in a plurality of concentric circular rows in a radial direction of said rotor.

10. A vortex pneumatic classifier according to claim 9, wherein said plurality of concentric circular rows includes an inner circular row and an outer circular row, a number of said plurality of rotor blades provided in said inner circular row is less than a number of said plurality of rotor blades provided in said outer circular row.

11. A vortex pneumatic classifier according to claim, 7, wherein said rising formation includes a conical member rising from an inner perimeter of said rotor blades toward said rotor shaft.

12. A vortex pneumatic classifier according to claim 11, wherein art angle (θ) of said conical member against said base is determined in relation to rotor height (H), and art inscribed circle radius (R3) of said rotor blade so as to meet the condition of $$\theta=\tan^{-1}\{(0.3\sim0.6)H/R3\}.$$

13. A vortex pneumatic classifier comprising: a rotor chamber with an inlet duct, a rotor having rotor blades placed at said inlet duct of said rotor chamber, a classifying chamber provided at a perimeter of said rotor chamber, and a flow-straightening vane provided inside said rotor chamber in a concentrical manner with a shaft of said rotor, wherein said flow-straightening vane includes plane-shaped flow-straightening plates, which are in an inverse triangular form, each of said flow-straightening plates having a lower portion formed in a curved plane.

14. A vortex pneumatic classifier according to claim 13, wherein said flow-straightening vane is fixed to said shaft of said rotor.

15. A vortex pneumatic classifier according to claim 13, wherein said flow-straightening vane is fitted over said shaft of said rotor and is fixed to a casing.

16. A vortex pneumatic classifier according to claim 13, wherein said flow-straightening vane is disposed above a rising formation.

17. A vortex pneumatic classifier according to claim 13, wherein said flow-straightening vane has at least a lower portion fixed to a slant face of a rising formation.

18. A vortex pneumatic classifier comprising: a rotor chamber with an inlet and an exhaust duct, rotor blades placed at said inlet of said chamber, a classifying chamber defined around said rotor chamber, guide vanes provided around said classifying chamber, a classifying air supply passage provided around said guide vanes, and a conical member provided inside said rotor chamber in a concentrical manner with a rotor shaft within said rotor chamber, wherein an angle (θ) of a slant face of said conical member against a base surface is determined in relation to rotor height (H), and an inner radius (R3) of said rotor blades so as to meet the condition of $$\theta=\tan^{-1}\{(0.3\sim0.6)\ H/R3\}.$$

19. A vortex pneumatic classifier according to claim 18, wherein said conical member rises from an inner perimeter of said rotor blades toward said rotor shaft.

* * * * *

UNITED STATES PATENT AND TRADEMARK OFFICE

CERTIFICATE OF CORRECTION

PATENT NO. : 5,533,629

DATED : July 9, 1996

INVENTOR(S) : Mitsuhiro Ito et al.

It is certified that error appears in the above-indentified patent and that said Letters Patent is hereby corrected as shown below:

Column 3, line 35;
"$P \leq 104 \times Dp(th)^{0.365}$" should be –$P \leq 1.04 \times Dp(th)^{0.365}$–.

Column 6, line 10;
"air density p f" should be –air density $\rho$ f–.

Column 9, line 50;
"the rotor B" should be –the rotor 5–.

Column 9, line 57;
"of the rotor" should be –of the rotor 5–.

Column 11, line 49;
"the rotor chamber 8 T" should be –the rotor chamber R T–.

Column 12, line 13;
"The fourth embodiment" should be –The 10th embodiment–.

Column 15, Claim 12, line 2;
"art angle ( $\theta$ )" should be –an angle ( $\theta$ )–.

UNITED STATES PATENT AND TRADEMARK OFFICE

CERTIFICATE OF CORRECTION

PATENT NO. : 5,533,629

DATED : July 9, 1996

INVENTOR(S) : Mitsuhiro Ito et al.

It is certified that error appears in the above-indentified patent and that said Letters Patent is hereby corrected as shown below:

Column 15, Claim 12, line 3-4;
"art inscribed circle radius (R3)" should be –an inscribed circle radius (R3)–.

Signed and Sealed this

Eighth Day of October, 1996

Bruce Lehman

*Attest:*

BRUCE LEHMAN

*Attesting Officer*

*Commissioner of Patents and Trademarks*